US005183525A

United States Patent [19]

Thomas

[11] Patent Number: 5,183,525

[45] Date of Patent: Feb. 2, 1993

[54] HEATER FOR A DOUBLE FACING CORRUGATING MACHINE

[75] Inventor: Charles E. Thomas, Baltimore, Md.

[73] Assignee: United Container Machinery Group, Inc., Glen Arm, Md.

[21] Appl. No.: 528,294

[22] Filed: May 24, 1990

[51] Int. Cl.[5] ..... B31F 1/28

[52] U.S. Cl. ..... 156/470; 156/210; 156/497; 156/499; 156/583.5; 165/168

[58] Field of Search ..... 156/470, 583.5, 459, 156/471, 472, 210, 499, 497; 425/369, 370; 165/168, 170

[56] References Cited

U.S. PATENT DOCUMENTS

| | | | |
|---|---|---|---|
| Re. 30,302 | 6/1980 | Stanislaw | 165/89 |
| 782,558 | 2/1905 | Hahn | 156/470 X |
| 1,035,266 | 8/1912 | Taylor | 156/470 X |
| 1,504,218 | 8/1924 | Crowell . | |
| 2,572,972 | 10/1951 | Baldwin | 165/168 |
| 2,932,091 | 4/1960 | Day | 34/124 |
| 2,936,158 | 5/1960 | Ramundo | 257/95 |
| 3,120,867 | 2/1964 | Nash | 165/90 |
| 3,175,300 | 3/1965 | Nitchie | 34/48 |
| 3,176,764 | 4/1965 | Barbera | 165/168 |
| 3,226,840 | 1/1966 | Moser et al. | 34/41 |
| 3,228,462 | 1/1966 | Smith, Jr. | 166/89 |
| 3,340,125 | 9/1967 | Drenning et al. | 156/274 |
| 3,347,732 | 10/1967 | Stewart | 156/497 |
| 3,581,812 | 1/1971 | Fleissner | 165/89 |
| 3,861,057 | 1/1975 | Wittstock et al. | 34/54 |
| 4,042,446 | 8/1977 | Lawton | 156/470 X |
| 4,050,510 | 9/1977 | Theysohn | 165/89 |
| 4,453,593 | 6/1984 | Barthel et al. | 165/89 |
| 4,459,726 | 7/1984 | O'Brien et al. | 29/116 |
| 4,556,444 | 12/1985 | Schommler | 156/359 |
| 4,683,627 | 8/1987 | Reinhold | 29/110 |
| 4,723,484 | 2/1988 | Held | 156/583.5 X |
| 4,738,744 | 4/1988 | Saller | 156/472 |
| 4,771,683 | 9/1988 | Schermutzki | 156/583.5 X |
| 4,935,082 | 6/1990 | Bennett et al. | 156/470 X |
| 5,005,473 | 4/1991 | Ishibashi | 156/470 X |

FOREIGN PATENT DOCUMENTS

| | | |
|---|---|---|
| 1179908 | 2/1970 | United Kingdom . |
| 1532762 | 11/1978 | United Kingdom . |

*Primary Examiner*—Michael W. Ball
*Assistant Examiner*—Michele K. Yoder
*Attorney, Agent, or Firm*—Biebel & French

[57] ABSTRACT

A heater for a double facing apparatus includes a flat metal plate where channels are drilled through end faces of the plate. Slots are provided at the end faces of the plate to interconnect pairs of adjacent channels at alternate ends to form a serpentine steam passage through the plate. The channels are positioned through the plate proximate to the upper surface of the plate, to define a thin web of plate material between the channel and the upper surface and a thick web of material between the channel and the lower surface of the plate. End caps are welded over the slots to seal the communication between the adjacent interconnected pair of channels. Steam supply ports extend into the serpentine path to steam pressurize the serpentine passage. Air vents can be supplied between some adjacent channels of the heater, extending between an upper and a lower surface of the plate. These air vents can be used to present air pressure to the lower side of the heater to lift the paper off of the heater, or can be used to present a vacuum to the board to draw the paper against the heater.

18 Claims, 14 Drawing Sheets

254b
256a
258
246
253a
253b
252a
252b
252c
248
252
251
251a
251b
255
254a
254c
256b

HEATER FOR A DOUBLE FACING CORRUGATING MACHINE

BACKGROUND OF THE INVENTION

The invention relates to an apparatus for producing double face corrugated board, and more particularly relates to an improved heating mechanism for gelatinizing the adhesive between single face corrugated board and second liner to form the double face corrugated board.

DESCRIPTION OF THE PRIOR ART

Manufacturing double face corrugated board typically begins with an apparatus known as a single facer. The single facer forms the corrugated center section, or "medium" and subsequently adheres the corrugated medium to a first liner paper to form single face board. The single facer includes two splined or corrugating rolls profiled to mesh together. To form the corrugations or "flutes", the medium is preheated and steamed to loosen and condition the paper fibers for the corrugating phase. The conditioned medium is then fed into the nip point of the two corrugating rolls, and the medium conforms to the contour of the interengaging corrugating rolls to form the flutes in the medium.

The single facer also includes a pressure roll in tangential abutment with one of the corrugating rolls. To adhere the corrugated medium to a first liner paper, the corrugated medium is transferred from the nip point between the two corrugating rolls to the nip point between the corrugating roll and the pressure roll. During this transfer, the flutes of the medium remain within the respective corrugations of the corrugating roll.

Adhesive is then applied to the flute tips of the corrugated medium and a first liner is fed into the nip point between the corrugating roll and the pressure roll. Both the pressure roll and the corrugating roll are heated and the combination of heat and pressure gelatinizes the adhesive between the medium and first liner paper, forming bonded single face corrugated board.

The gelatinization between the corrugated medium and the first liner paper can be accomplished relatively rapidly without crushing the flutes on the existing corrugated sheet. As the formed medium remains within the contour of the corrugated roll, the individual corrugations on the corrugated roll provide a back up to the medium, and the flute tips of the medium are individually pressed against the first liner paper.

However, when a second liner paper is placed on the opposite side of the medium, a process called double facing, the heating of the second liner and the corrugated medium has in the past, presented a problem. Because the second liner paper now covers the flute tips, there is no mechanism for backing up the flute tips, so only a small amount of pressure can be applied to the second liner paper to ensure that the corrugated paper is not crushed.

In order to heat the second liner paper, an array of steam heating vessels are aligned in side-by-side registration, and the double face corrugated board is pulled over the upper surface of the vessels. Several of these vessels, each being approximately 2 feet wide and 9 feet in length, are placed with the length of the vessel spanning the track to receive the double face board. The heating vessels are comprised of cast iron and have central chambers for the pressurized steam, and inlet and outlet ports in the lower surface for the continuous flow of steam. The heating vessels typically operate with approximately 185 psig steam at 370° F.

In order to press the second liner and the single face board against the heating vessels, a continuous belt overlies the corrugated board, and weight rolls are placed over the top of the belt. This type of heating vessel and weight roll combination has many drawbacks.

First, since the vessel used in the present art has a large internal void, and has operating conditions as mentioned above, the vessel must be qualified as a "pressure vessel" under the ASME pressure vessel code. This qualification increases the price of the vessel, and also complicates construction. Since the heating vessel is qualified as such a pressure vessel, the walls of the pressure vessels must be relatively thick to pass the ASME inspection, and typically, the wall thickness is approximately 1 7/16 inch, causing further complications and inefficiencies.

Due to the thickness of the vessel walls, energy is lost in conducting heat from the inner wall surface to the outer wall surface, reducing the thermal efficiency of the vessel. Said differently, as the wall thickness of the vessel increases, the maximum possible heat transfer rate decreases between the heating vessel and the double face corrugated board.

With previous heating vessels, the steam is supplied at 370° F., and when the double facer is not operating, both the upper and lower surface of the vessel typically reach 360° F. However, when the double facer apparatus is operated, the thickness of the walls prevents a high heat transfer rate between the steam and the outer heating surface, and the surface temperature can only be retained at approximately 300° F.

When these vessels are in a static condition and heated to their proper operating conditions, they cooperatively provide a smooth continuous heated surface across the plane formed by the several vessels. In fact, the typical specifications which apply to these heating plates require that the upper surfaces of the plates must be flat within 0.001 inches. However, as mentioned above, when corrugated board is moved quickly over the heated vessels, and heat is drawn from the upper surface of the vessels for the gelatinization of the adhesive, the temperature of the upper surface of the heating vessel is lowered relative to the lower surface of the vessel. This temperature differential in the heating vessels causes dissimilar heat expansions between the upper and lower surfaces of the heating vessel, both lengthwise and crosswise, forming an upwardly facing concave shape. In fact, the lengthwise thermal distortion can be as high as 0.060 inches.

This concave shape causes the weight rolls to unevenly pressurize the flowing board passing over the heating vessels, causing at some points, crushing of the corrugated material thereby weakening the material, while at other positions, no pressurization at all. In either event, the process results in weakened and poorly bonded board.

Another disadvantage to the present heating system is that it is inadequate for processing a variety of thicknesses of board. Typically, a variety of strengths of board are produced by varying the thicknesses of the papers used. While the same process machinery will manufacture single face corrugated board from a variety of thicknesses of original paper, the present heating vessels and weight rolls are inflexible for varying the operating conditions for the manufacture of double face board.

For example, when manufacturing corrugated board from thick paper, the heat load required for the gelatinization of the adhesive is higher than that for thin paper. If thin board is being manufactured, the weight rolls towards the end of the line must be inactivated, so that the board is not pressed against the heating vessels. While this inactivation helps somewhat, the pressure from the belt alone continues to press the board against the vessels.

In one attempt to inactivate the pressure from the belt, an upwardly projecting jet of air was provided between adjacent heating vessels to cause a flotation of the board above the vessels. This attempt too has proven to be unsuccessful. The only access for the jet is between adjacent heating vessels, and it is difficult to provide for an effective seal due to the high operating temperatures of the vessels. Also, the large span between consecutive jets, due to the width of the individual heating vessels, does not allow for an effective flotation of the board.

A further disadvantage of the above-mentioned system is that, conceptually at least, it has always been desirable to provide for an air pressurized downward force on the board through the heating vessels to assist in the heating of the board. Due to the inability to achieve atmospheric pressure beneath the board, the attempt at pressurization of the board from above has only led to a fluttering of the board, rather than the desired positive hold down. This same drawback is found in the reverse situation, where a vacuum is presented beneath the board, in an attempt to draw the board towards the heating vessels.

A further disadvantage of the above-mentioned system is that the center section of the corrugated board tends to gelatinize first, leaving the outer edges to be cured later in the process. If the entire corrugated board continues to heat, the center of the corrugated board could overheat, causing the center section to curl, creating a distorted and weakened structure.

It is an object of the invention then, to provide for a heating apparatus having greater thermal efficiency.

It is a further object of the invention to provide for a heating apparatus which will not thermally distort when the heaters are in operation.

It is a further object of the invention to provide for a heating apparatus which is simpler in design, allowing the vessel to be more easily approved for use.

It is a further object of the invention to provide for a heating vessel which will allow air pressurization from below as a means of lifting the board from the heating surface to vary the process heating time.

It is a further object of the invention to provide for a heating vessel design, which will allow air pressurization from above or a vacuum beneath to retain the board against the heating vessels for more effective heating.

It is a further object of the invention to provide for a heating vessel design which will allow for various temperatures along the upper surface of the vessel.

Other objects and advantages of the invention will be apparent from the following description, the accompanying drawings and the appended claims.

SUMMARY OF THE INVENTION

The objects of the invention were accomplished by designing a heating apparatus comprising at least one flat discrete plate having an upper surface and a lower surface. The heater has side-by-side channels extending from one end of the plate to an opposite end, the channels being proximate to the upper surface of the plate, thereby forming a thin web of material between the channels and the upper surface, and a thick web of material between the channels and the lower surface to thereby rigidify the plate. The heating apparatus also includes means to interconnect adjacent pairs of channels at alternate ends to form a continuous serpentine passageway parallel to the plane of the upper surface. The heating apparatus also includes at least one steam inlet port and at least one steam outlet port communicating with the serpentine passageway.

By having a plurality of channels in the plate, the heater is much simpler in design, alleviating the requisite qualifications of the heater as a pressure vessel. Because the vessel does not have to be qualified, the channels can be located adjacent to the upper surface of the plate, forming a thin web of material between the channels and the upper surface. This allows the upper surface of the plate to attain a higher temperature than previous heating vessels. By having a thick web of material between the channels and the lower surface, the web rigidifies the plate, reducing thermal distortion.

DETAILED DESCRIPTION OF THE PREFERRED EMBODIMENT

Figure 1:
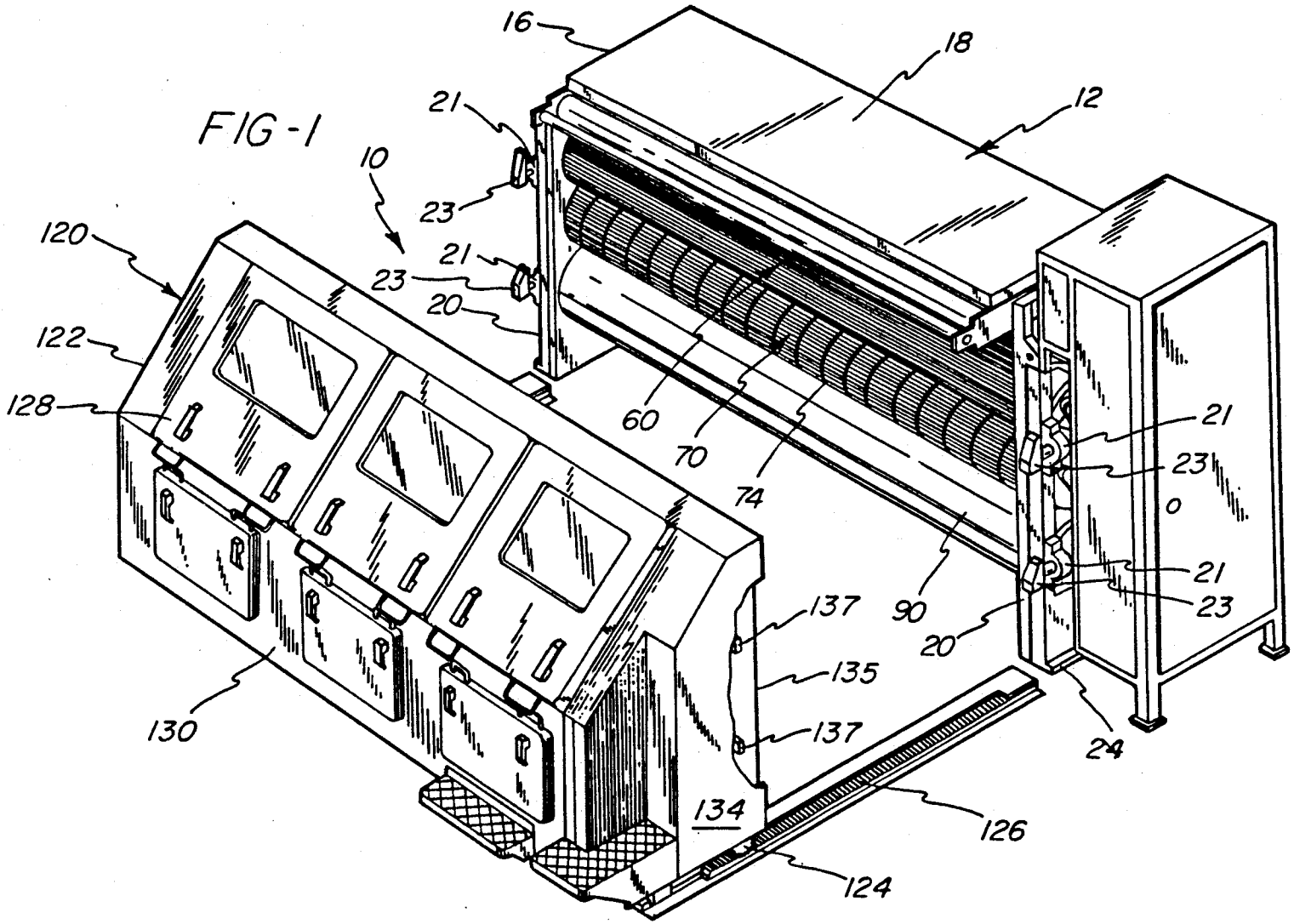
FIG. 1 is a perspective view of a single facer corrugating apparatus.

In the manufacture of double face corrugated board, a single facer corrugating machine generally produces single face board, which is subsequently processed into double face board. With reference first to FIG. 1, a single facer corrugating apparatus is shown generally at 10, comprising a corrugating portion 12, and a movable glue unit 120. The single facer apparatus is more fully described in U.S. patent application Ser. No. 528,306, issued on Oct. 10, 1992 as U.S. Pat. No. 5,156,714 and Ser. No. 528,268, issued Nov. 3, 1992 as U.S. Pat. No. 5,160,400, incorporated herein by reference.

Figure 2:
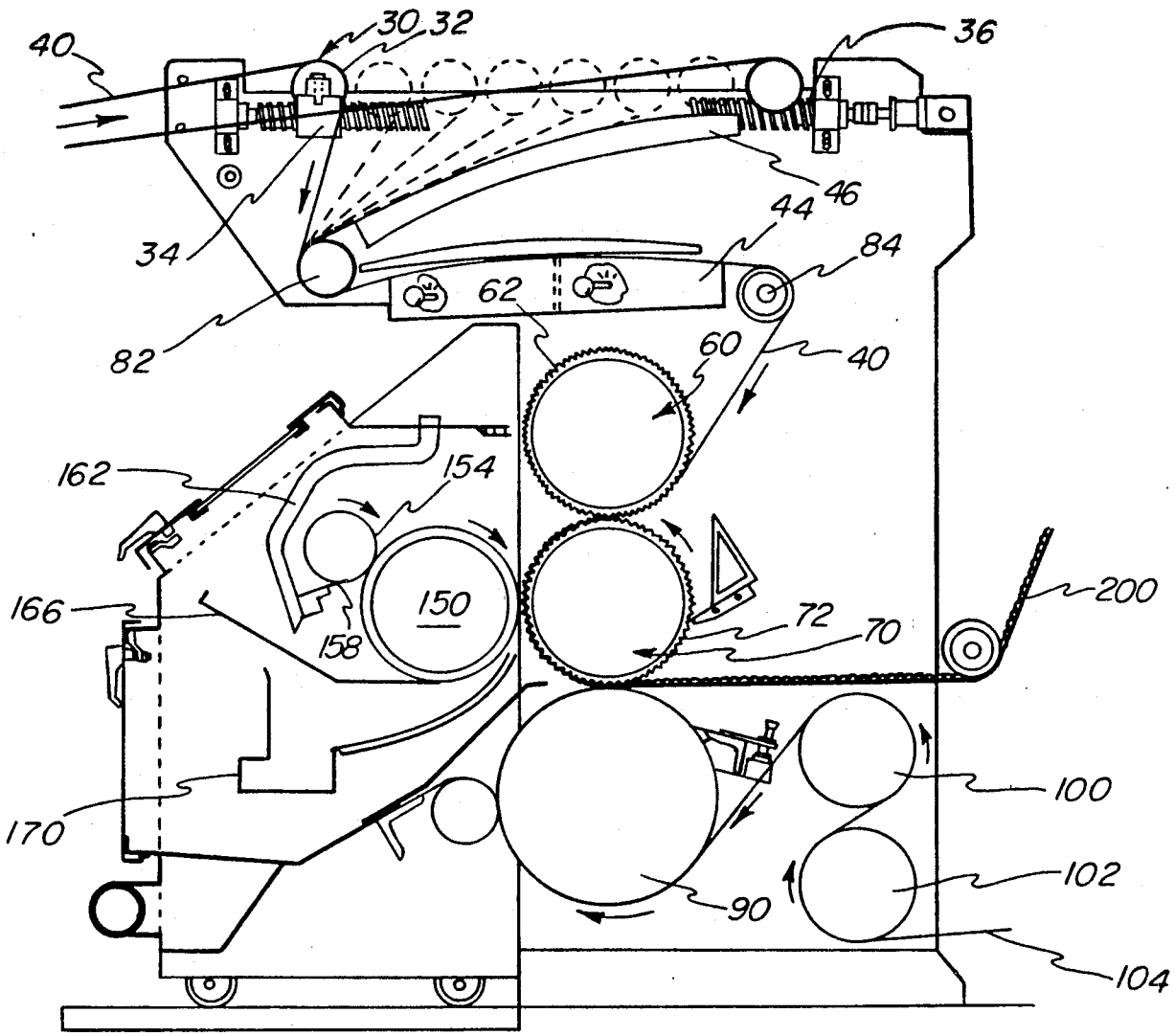
FIG. 2 is a side diagrammatical view of the single facer apparatus of FIG. 1.

With reference now to FIG. 2, the corrugating apparatus includes a variable wrap mechanism 30 including a roll 32 rotatably attached to threaded carriers 34, driven by worm gears 36. As shown in FIG. 2, the threaded carrier 34 and roll 32 is movable from the leftmost position to the rightmost position, to vary the surface area contact between the medium 40 and the heating unit 46. The medium 40 is driven by the driven roll 82 which is powered by a constant torque hydraulic motor (not shown). The medium 40 is also threaded around the idler roll 84, causing the medium to pass over the steam chamber 44.

Two corrugating rolls are also included, an upper corrugating roll 60 and a lower, and driven corrugating roll 70, the two rolls 60 and 70 having complementary sinuous shaped meshing teeth. The apparatus also includes a driven pressure roll 90 which is in tangential abutment with the lower corrugating roll 70. The corrugating portion 12 further comprises two preheating driven rolls 100 and 102.

As shown in FIG. 1, the roll away glue unit 120 comprises a structural housing 122 having rolls 124 which are complementary with the linear track 126 allowing the frame 122 to be driven away from the corrugating unit 12. The roll away glue unit 120 also includes a glue supply system including a glue roll 150 in engagement with the lower corrugating roll 70, a metering roll 154, a glue supply manifold 162, a glue pan 166, a scraper blade 158 and a glue return manifold 170.

With reference to FIG. 2, the paper 40 to be corrugated, typically referred to as the medium, is fed over the roll 32, and over the rolls 82 and 84. With the threaded carrier 34 properly adjusted along the worm gear track 36 to provide for the appropriate angle of wrap of the medium 40 with the preheater 46, the paper medium 40 is first heated by the preheater 46 and later conditioned by the steam chamber 44.

With the medium 40 heated and conditioned by the heater 46 and steam chamber 44, the fibers of the medium are somewhat loosened and softened and are fed into the nip point of the upper and lower corrugated rolls 60 and 70 reshaping the medium 40 into flutes having the same configuration as the teeth 62, 72 of the corrugating rolls 60, 70. The corrugated medium continues around the lower corrugating roll 70 where adhesive is applied to the tips of the flutes by the rotating glue roll 150.

The paper 104, typically referred to as the liner, is preheated by the heated rolls 100 and 102 and is fed around the pressure roll 90 and into the nip point created by the lower corrugating roll 70 and the pressure roll 90. The corrugated medium 40 and the liner paper 104 are merged at this nip point and, due to the heated pressure roll 90, the medium is cured and the adhesive gelatinized to form the single faced corrugated board 200.

Figure 3:
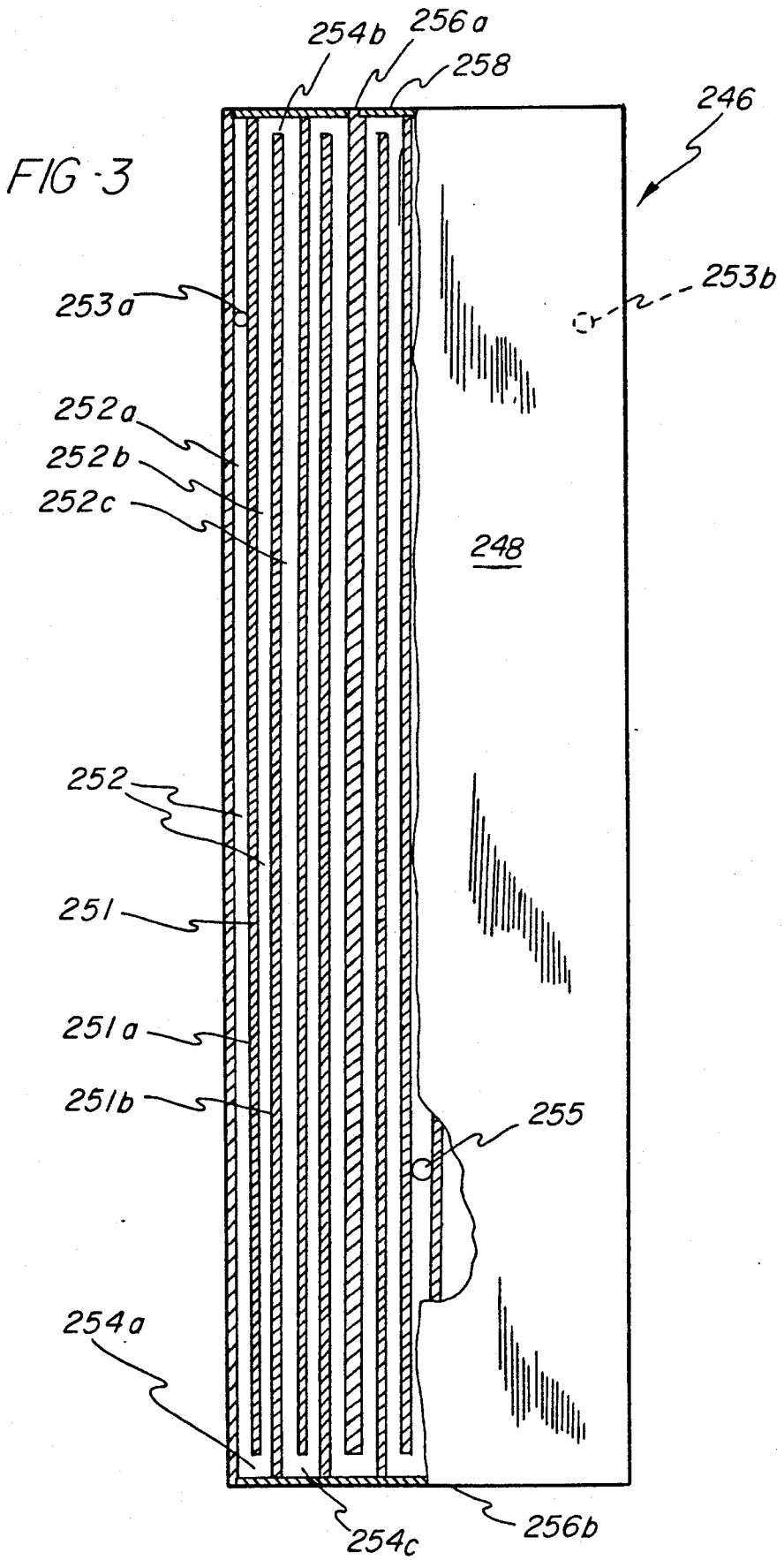
FIG. 3 is a top plan view of the heater used in the double facer apparatus, where the heater is partially broken away to show the internal structure.
Figures 4, 5:
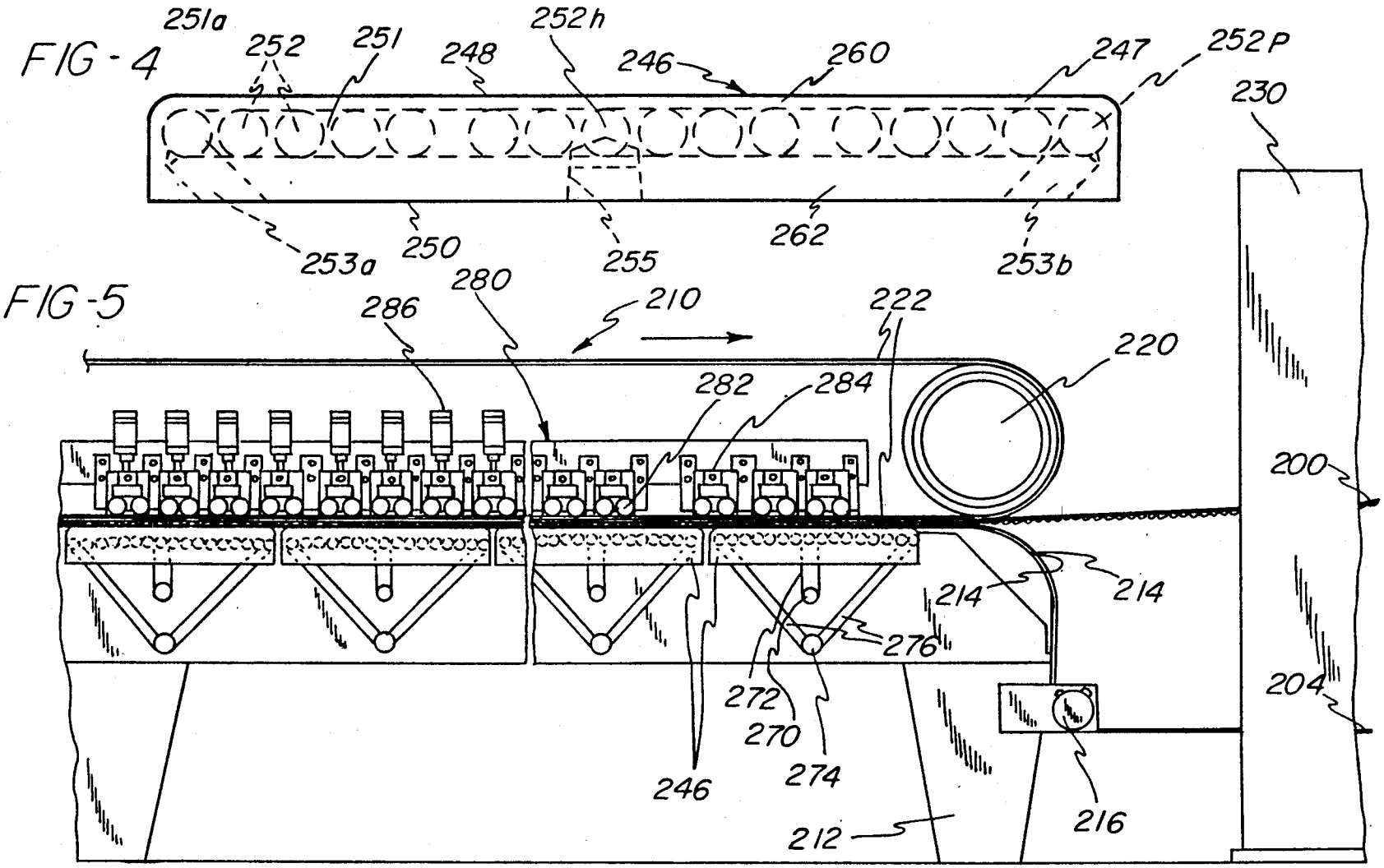
FIG. 4 is an enlarged end view of the heater shown in FIG. 3.
FIG. 5 is a diagrammatical view of the double facer apparatus showing an array of heaters for forming the double faced corrugated board.

With reference now to FIG. 5, the double facer apparatus is shown generally at 210 and includes a structural frame 212, a plurality of heaters 246 arranged in a side-by-side array, a continuous belt 222 positioned adjacent above the single faced corrugated paper 200, and a weight roll mechanism 280 for applying pressure against the continuous belt 222. A mechanism 230 is shown diagrammatically as receiving both single faced corrugated paper 200 and the second liner paper 204. This mechanism 230 includes conventional preheating units and a glue unit. With reference now to FIGS. 3 and 4, the heaters 246 will be described in greater detail.

The heater 246 includes a metal plate 247 having an upper surface 248 and a lower surface 250. A plurality of channels are shown generally at 252 extending between the end faces 256*a* and 256*b* of the plate 247. As shown in FIG. 4, the channels 252 are cylindrical in nature thereby forming hourglass-shaped walls 251 between adjacent channels 252. Slots shown generally at 254 are included at alternate opposite ends to interconnect adjacent channels 252 to form a serpentine path through the plate 247. While the walls, channels and slots are referred to generally by the reference numerals 251, 252 and 254, a particular item will be referred to by the reference numeral in combination with a lower case letter, as more clearly shown in FIGS. 3 and 4.

More specifically, as shown in FIG. 3, slot 254*a* is included at end 256*b* of the plate 247, to interconnect the first two channels 252*a* and 252*b*. At the opposite end 256*a*, slot 254*b* interconnects the second and third channels 252*b* and 252*c*. Each pair of adjacent channels 252 are interconnected at alternate ends to form a serpentine path through the plate 247.

The heating plate 247 further includes a steam inlet port 255 located in the center of the plate 247 to intersect with channel 252*h* from the lower surface 250 of the plate 247, as shown in FIG. 4. The plate 247 also includes a steam outlet port 253*a* intersecting with the channel 252*a*, and a steam outlet port 253*b* intersecting with the channel 252*p*. As the steam inlet port 255 is centrally located relative to the width of the plate 247, the steam flow is bi-directional within the channel 252*h*, and a portion will travel through the serpentine path in the plate 247 and exit through exit port 253*a*, while the remainder of the steam flow travels in the opposite direction within channel 252*h*, and exits through the outlet port 253*b*.

In the preferred embodiment of the invention, the channels 252 are formed by drilling through the plate 247 between opposite end faces. The channels 252 are drilled through the plate 247 at a position proximate to the upper surface 248, defining a thin web 260 between the channel and the upper surface 248 and a thick web 262 between the channel 252 and the lower surface 250. Also in the preferred embodiment of the invention, the slots 254 are formed by removing, for example by milling away, portions of the walls 251 adjacent to the end faces 256*a* and 256*b* of the plate 247.

With reference again to FIGS. 4 and 5, the heaters 246 are shown arranged in a side-by-side array with the steam inlet port 255 interconnected to an inlet pipe 272 and a steam inlet manifold 270. Similarly, the steam outlet ports 253*a* and 253*b* in the heater 246 are interconnected to outlet piping 276 and a steam outlet manifold 274. The steam inlet manifold 270 is supplied with steam at approximately 185 psig at 370° F., to heat the upper surface 248 of each of the heaters 246 for the processing of the double faced corrugated board.

As shown in FIG. 5, the weight roll mechanism is shown generally at 280 and includes a continuous belt 222 wrapped around an idler roll 220 at one end, and around a driver roll (not shown) at the other end. The weight roll mechanism 280 further includes individual weight rolls 282 pressing against the back side of the continuous belt 222, pressing the corrugated board against the heaters 246. Lifting members 286 are included on some of the downstream weight rolls 282, to remove the weight of some of the rolls 282 from the belt, to control the heat imparted to the passing board.

With reference still to FIG. 5, both the single faced corrugated board 200, from the single facer apparatus of FIGS. 1 and 2, and the second liner paper 204 are fed through the conditioning mechanism 230 and are merged between the continuous belt 222 and an upper surface 214 of the frame 212. As the continuous belt 222 is positioned on top of the single faced corrugated board 200, the belt 222 drives both the single faced corrugated board 200 and the second liner paper 204 over the plurality of heaters 246 from right to left as viewed in FIG. 5.

As the single faced corrugated board 200 and second liner paper 204 are moved from the right to the left as shown in FIG. 5, the combination of the heat, from the heaters 246, and the pressure, imparted on the single faced corrugated board 200 by the individual weight rolls 282, gelatinizes the adhesive between the board 200 and paper 204 to form bonded double faced corrugated board. The weight of the paper being used to form the double faced corrugated board, and the speed at which the apparatus is operating, determines the amount of heat which should be imparted to the board 200 and paper 204.

If the paper used to make the double faced corrugated board is quite thin, and if the speed of operation is slow, then the adhesive is gelatinized prior to reaching the last heater 246. In such a case, the lifters 286 would be activated to remove the weight of some downstream weight rolls from the belt. On the other hand, if the paper forming the corrugated board is rather heavy, and the speed of operation is quite rapid, then in all likelihood, the weight rolls will not be lifted.

With the heaters 246 configured as shown in FIG. 4, the heaters 246 exhibit excellent thermodynamic and heat transfer characteristics. As the heaters 246 do not qualify as ASME pressure vessels, the channels 252 can be placed proximate to the upper surface 248 of the heater. In fact, in the preferred embodiment of the invention, the dimension Y as shown in FIG. 4, is approximately ⅜ inches. Due to the proximity of the channels 252 to the upper surface 248, the upper surface 248 can be maintained at a higher operating temperature than previous heaters. The upper surface 248 of the heater 246, when operating, can be maintained with a surface temperature between 330° F. and 340° F., whereas previous heating vessels could only be maintained with an upper surface temperature of 300° F.

Furthermore, the heaters 246 do not thermally distort like previous heaters. Even though when operating, the upper surface 248 will be at a lower temperature than the lower surface 250, a large mass of material formed by the web 262 below the channels 252 retains the heaters 246 in a rigid planar configuration. Only a thin web as at 260 is at a significantly lower temperature than the lower surface 250 and the temperature differential of the thin web 260 cannot thermally distort the thick web 262.

Figure 6:
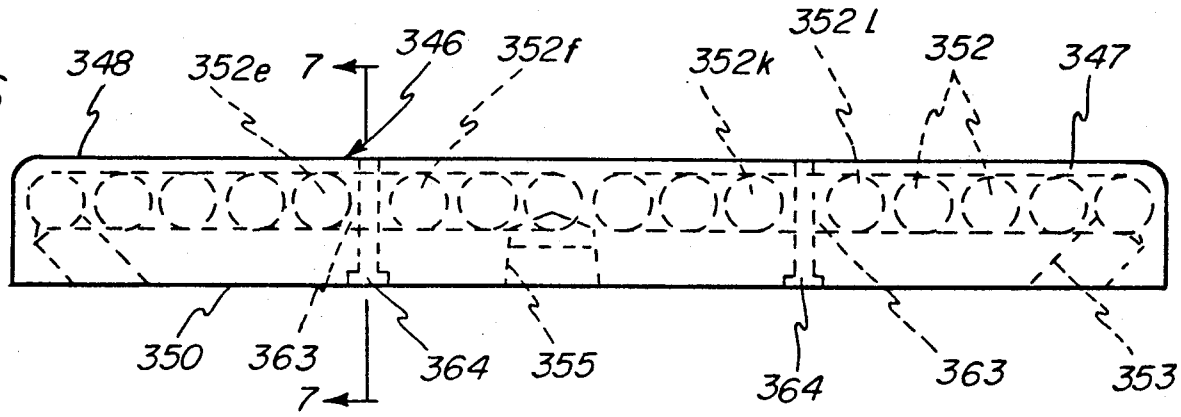
FIG. 6 is another embodiment of a heater for use with a double facer apparatus.
Figure 7:
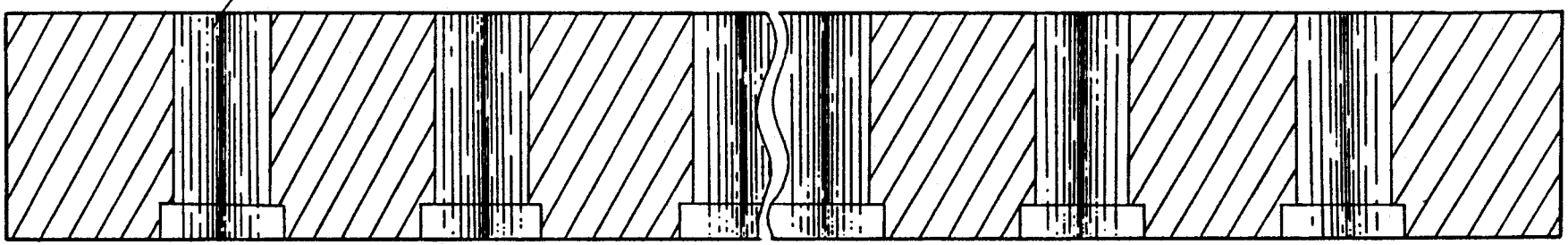
FIG. 7 is a cross-sectional view through lines 7—7 of FIG. 6.

As shown in FIG. 6, a further embodiment of heater is shown which is a modification to the heater 246 shown in FIG. 3. The heater 346 is constructed with are spaced apart to include air ducts between the channels. For example, channels 352*e* and 352*f*, and channels 352*k* and 352*m* have a greater center line spacing between them than other adjacent channels 352 to define a thickened wall 363 therebetween. This thickened wall 363 provides adequate space for an air duct 364 between the upper and lower surfaces 348 and 350. In the preferred embodiment, the air ducts are drilled through the plate, and are thereafter tapped from the lower surface 350 to form pipe threads at 364. Also in the preferred embodiment, the air ducts are laterally positioned every 2–3 inches as shown in FIG. 7.

Figure 8:
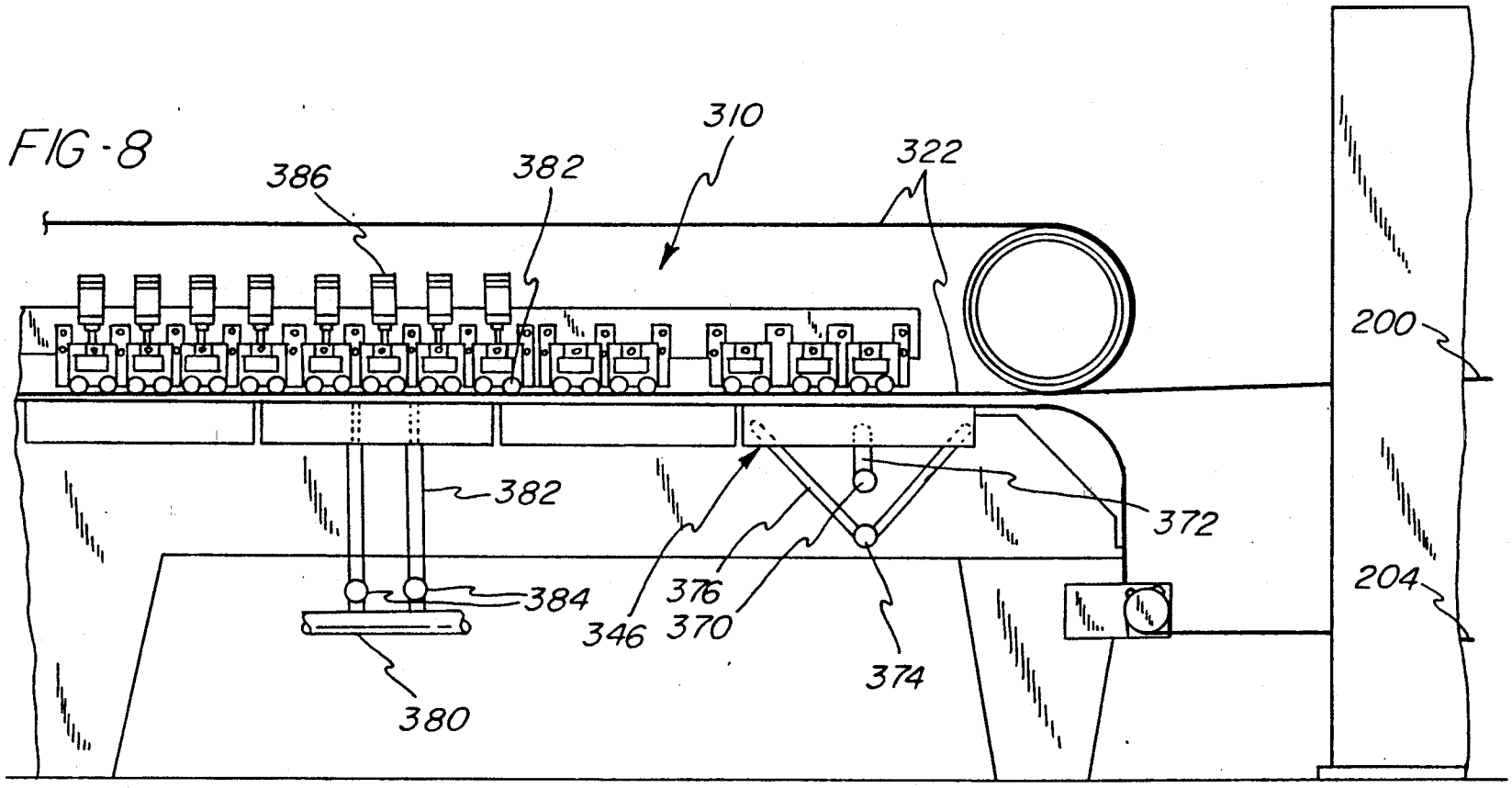
FIG. 8 is a diagrammatical view of a double facer apparatus using the heater shown in FIGS. 6 and 7.

As shown in FIG. 8, the heaters 346 are arranged into an array of side-by-side plates including inlet steam connections 370, 372 and outlet steam connections 374 and 376. In addition, the apparatus shown in FIG. 8 includes an inlet air manifold 380 with branches 382 being independently interconnected to the individual air inlet ducts 364 (FIG. 6).

When it is necessary to deactivate some of the individual weight rolls 382, the corresponding lifting mechanism 386 is activated which lifts the weight rolls from the back side of the continuous belt 322. In addition to lifting some of the individual weight rolls 382, the air inlet ducts 364 which are below the lifted weight rolls 382 can be pressurized by opening the control valves 384 between the air manifold 380 and the inlet pipe 382 thereby pressurizing the ducts 364 to form a cushion of air between the upper surface 348 of the heaters 346 and the second liner paper 204, thereby lifting the paper 204 and the singe face board 200 from the heating surface.

Figure 10:
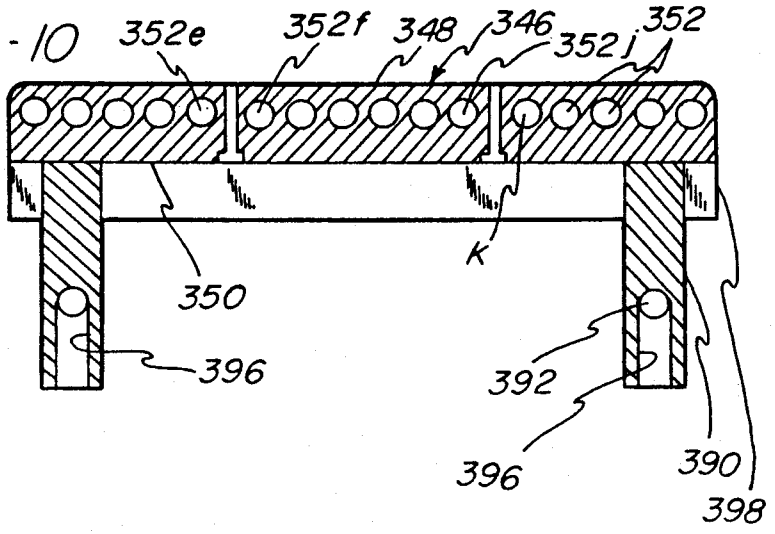
FIG. 10 is a cross-sectional view of the heater through lines 10—10 of FIG. 9.
Figure 11:
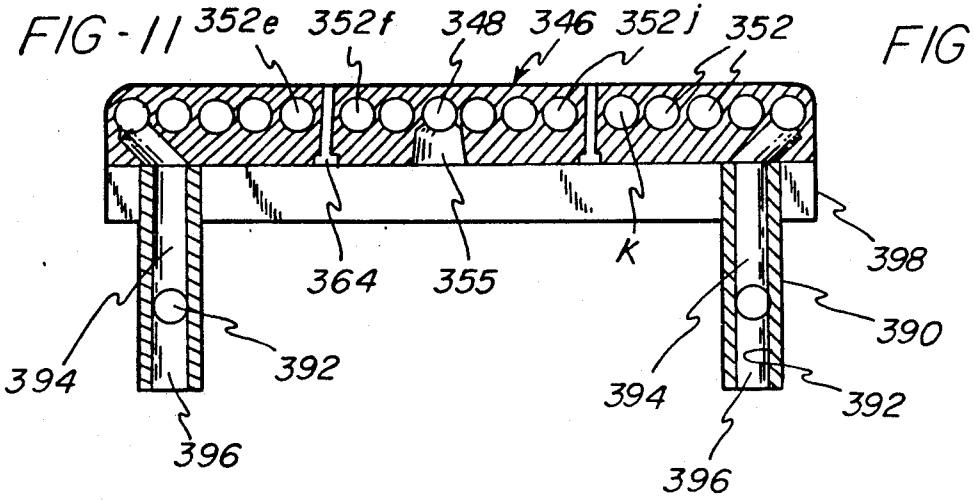
FIG. 11 is a cross-sectional view of the heater through lines 11—11 of FIG. 10.
Figure 9:
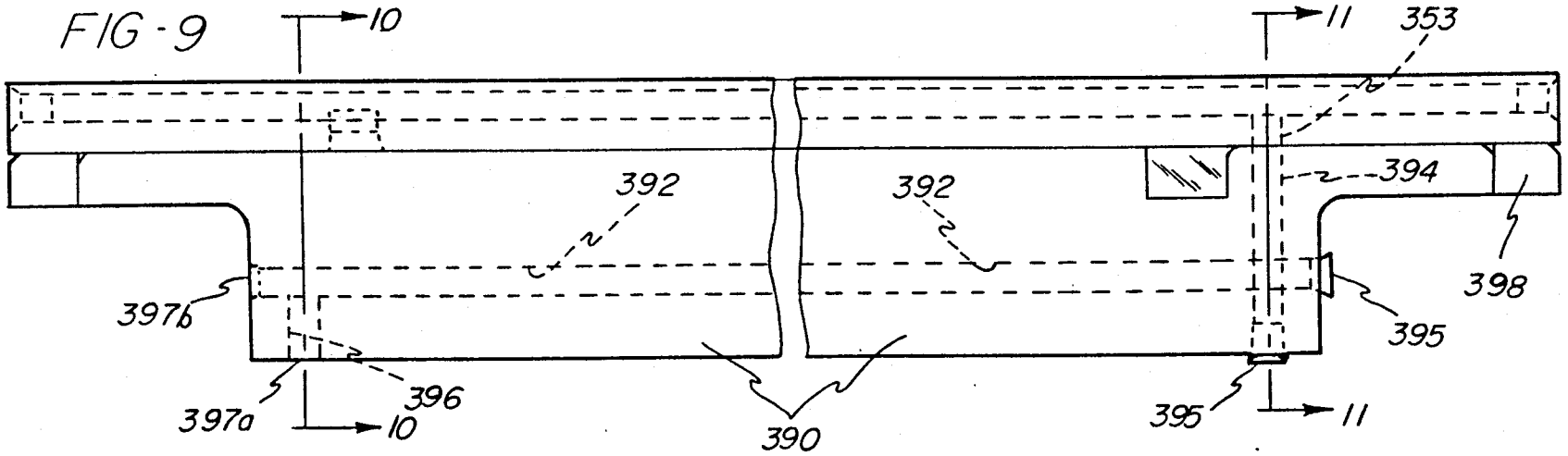
FIG. 9 is a side plan view of a further modification of the heater shown in FIG. 6.

Referring now to FIGS. 9, 10 and 11, the heater 346 can be further modified to include strengthening ribs 390 mounted to the lower surface 350 along the length of the heater 346, while strengthening ribs 398 are mounted to the lower surface 350 of the heater 346 extending laterally across the width of the heater 346. The ribs 390 and 398 provide rigidity to the heater to further prevent thermal distortion due to the temperature difference between the upper and lower surfaces 348 and 350.

As shown in FIGS. 9 and 11, the ribs 390 include vertical bores 394 positioned in alignment with the outlet ports 353, where the vertical bore 394 is plugged at its lower end as at 395 (FIG. 9). The strengthening rib 390 also includes a longitudinal bore 392 intersecting with the vertical bore 394 to form a continuous duct between the outlet port 353 of the heater 346 through the longitudinal bore 392. As shown in FIGS. 9 and 10, a second vertical bore 396 is adjacent to the front of the rib 390 and extends from a lower surface of the rib upwardly to a position where it intersects with the longitudinal bore 392. With the longitudinal bore 392 plugged as at 395 at the right end, as viewed in FIG. 9, two exit ports are defined within each rib 390, as shown in FIG. 9 as at 397*a* and 397*b*.

The bores 392, 394, and 396 provide a continuous heating duct for heating the strengthening ribs 390. In this manner, the strengthening ribs 390 are maintained at the same temperature as the plate 347 to ensure that the strengthening ribs 390 expand consistently with the expansion of the heater 346. While the inlet and outlet steam connections for the heaters 346, shown in FIGS. 9–11, are not specifically shown, it should be understood that the connections would be similar to those shown in FIG. 5, except that the steam outlet piping would be connected to one of the exit ports 397*a* or 397*b* in each rib 390.

Figure 12:
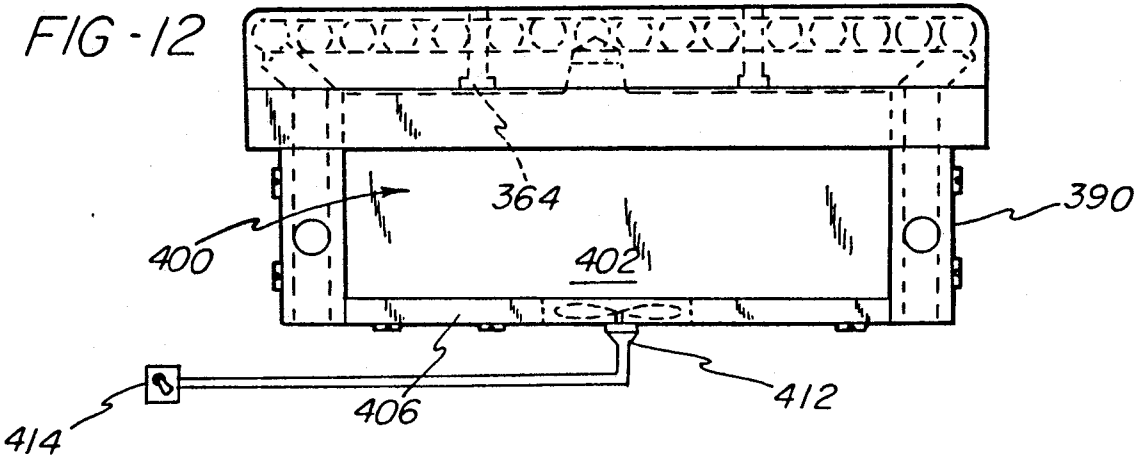
FIG. 12 is a front plan view of a further embodiment of a heater having a lower air plenum.
Figure 13:
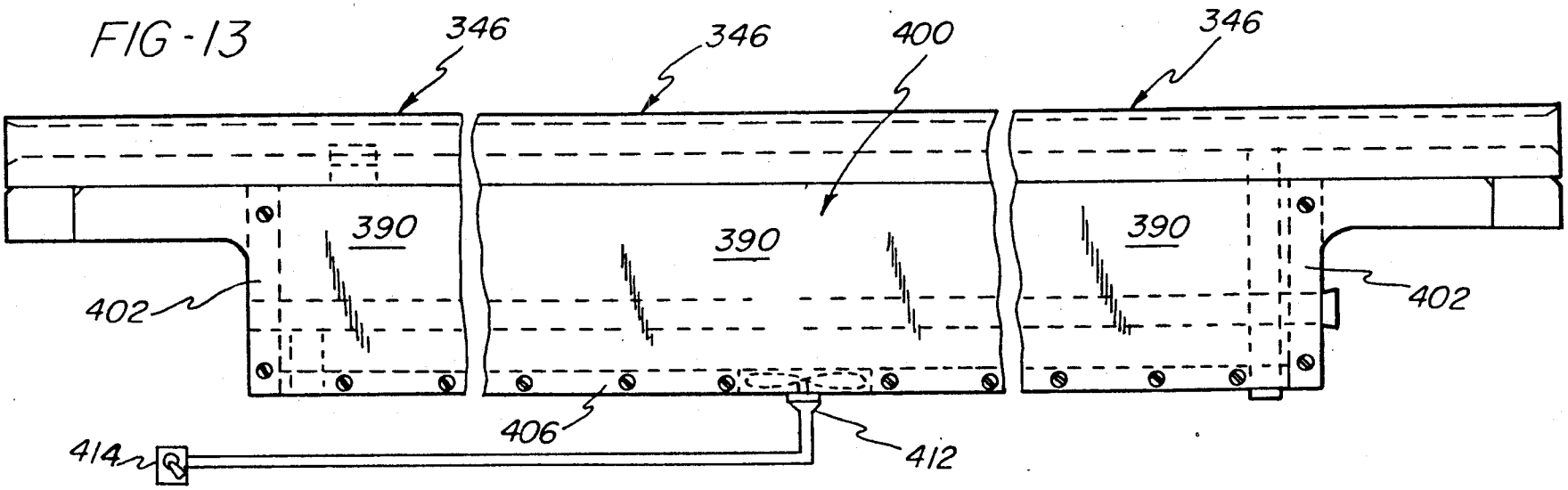
FIG. 13 is a side plan view of the heater shown in FIG. 12.

With reference now to FIGS. 12 and 13, the heater 346 can be further modified by forming a plenum chamber 400 beneath the heater 346. In the preferred embodiment of the invention, the ribs 390 are used as the side walls to the plenum and two sheet metal plates 402, as shown in FIG. 12, enclose the ends of the heater 346 between the two ribs 390 and are fastened thereto. A lower sheet metal plate 406 is also included and is attached to the inner surface of the ribs 390 and to the lower edge of the plates 402. A bi-directional variable speed fan 412 is attached to the lower plate 406 to provide air flow to the plenum 400 and is controlled by the control unit 414. Alternatively, an air interconnection, such as a pipe coupling, could be attached to the lower plate 406, and air piping could be attached to the individual plenums.

Figure 14:
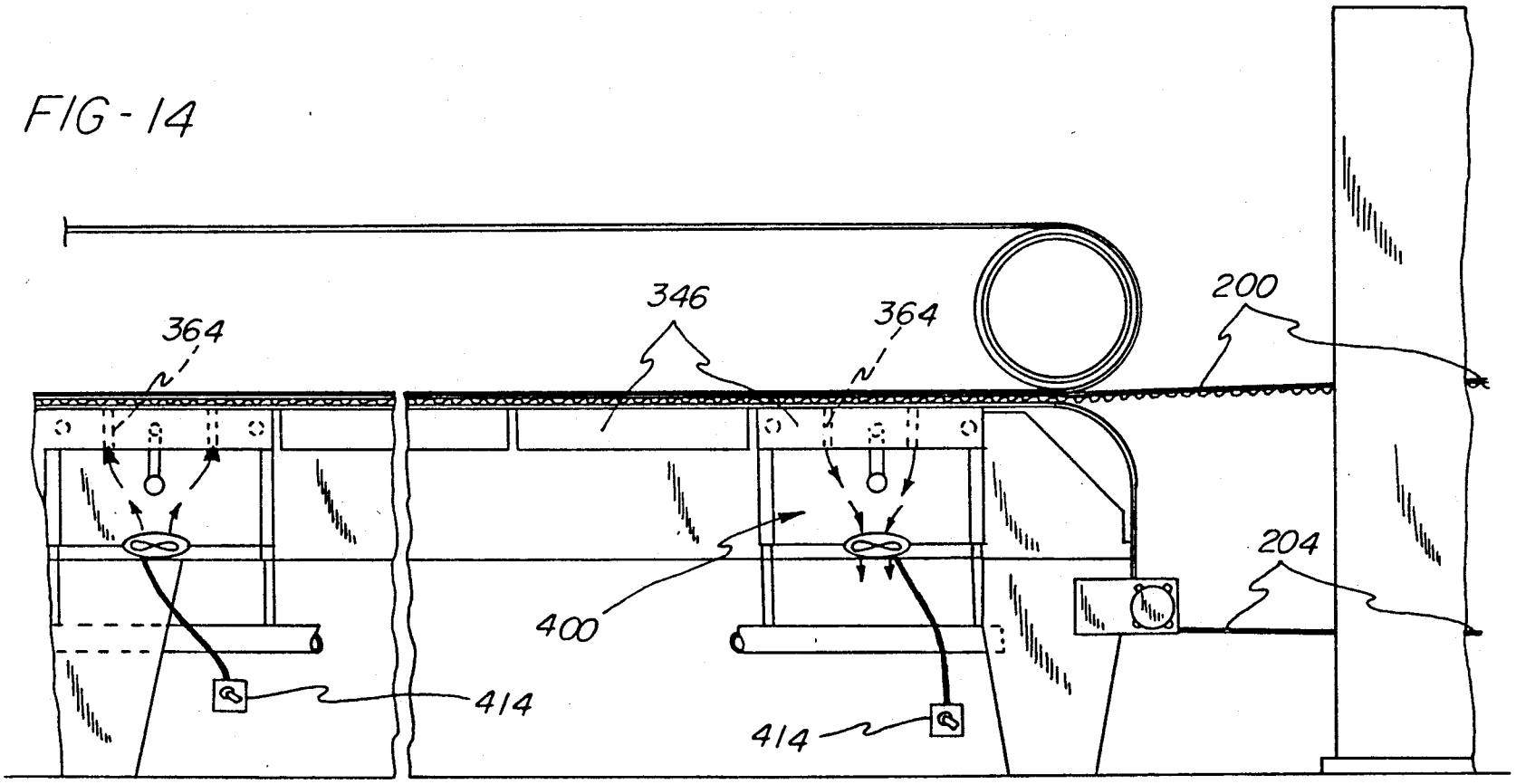
FIG. 14 is a diagrammatical view showing the double facer apparatus utilizing the heater shown in FIGS. 12 and 13.

The heater 346 and plenum 400 are shown diagrammatically in FIG. 14 where the heaters 346 are arranged in side-by-side registration. To ensure that the single faced corrugated board 200 and second liner paper 204 are forced against the heaters 346, the control unit 414 of the first plenum 400 is operated to provide a vacuum within the plenum 400 to draw the board against the heaters 346, to increase the heat transfer from the heaters 346 to the single faced board 200 and paper 204. Advantageously, in this configuration the vents provide for an array of vacuum ports and the amount of vacuum can be controlled by varying the speed of the fan 412.

The fans 412 are bi-directional and can also be operated to pressurize the plenum 400, as shown at the left in FIG. 14, to provide an air cushion beneath the second liner 204 to lift the second liner 204 and the belt away from the heater 346. It should be noted that in the embodiment shown in FIG. 14 the weight rolls have been eliminated and the heat transfer from the heaters 346 can be totally controlled by the fans 412 and control units 414.

Figure 15:
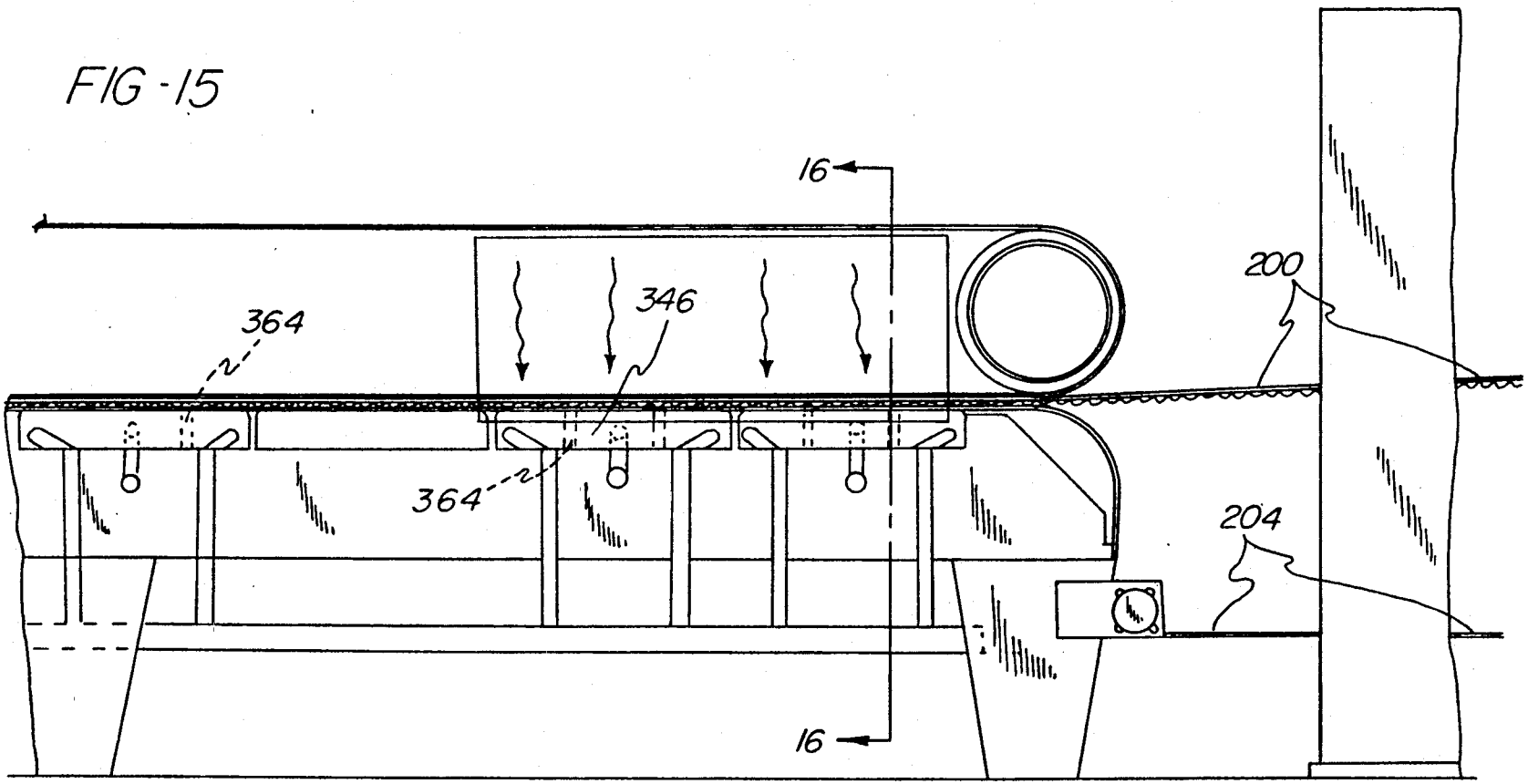
FIG. 15 is a diagrammatical view showing a further embodiment of double facer apparatus utilizing the heater of FIGS. 6 and 7.
Figure 16:
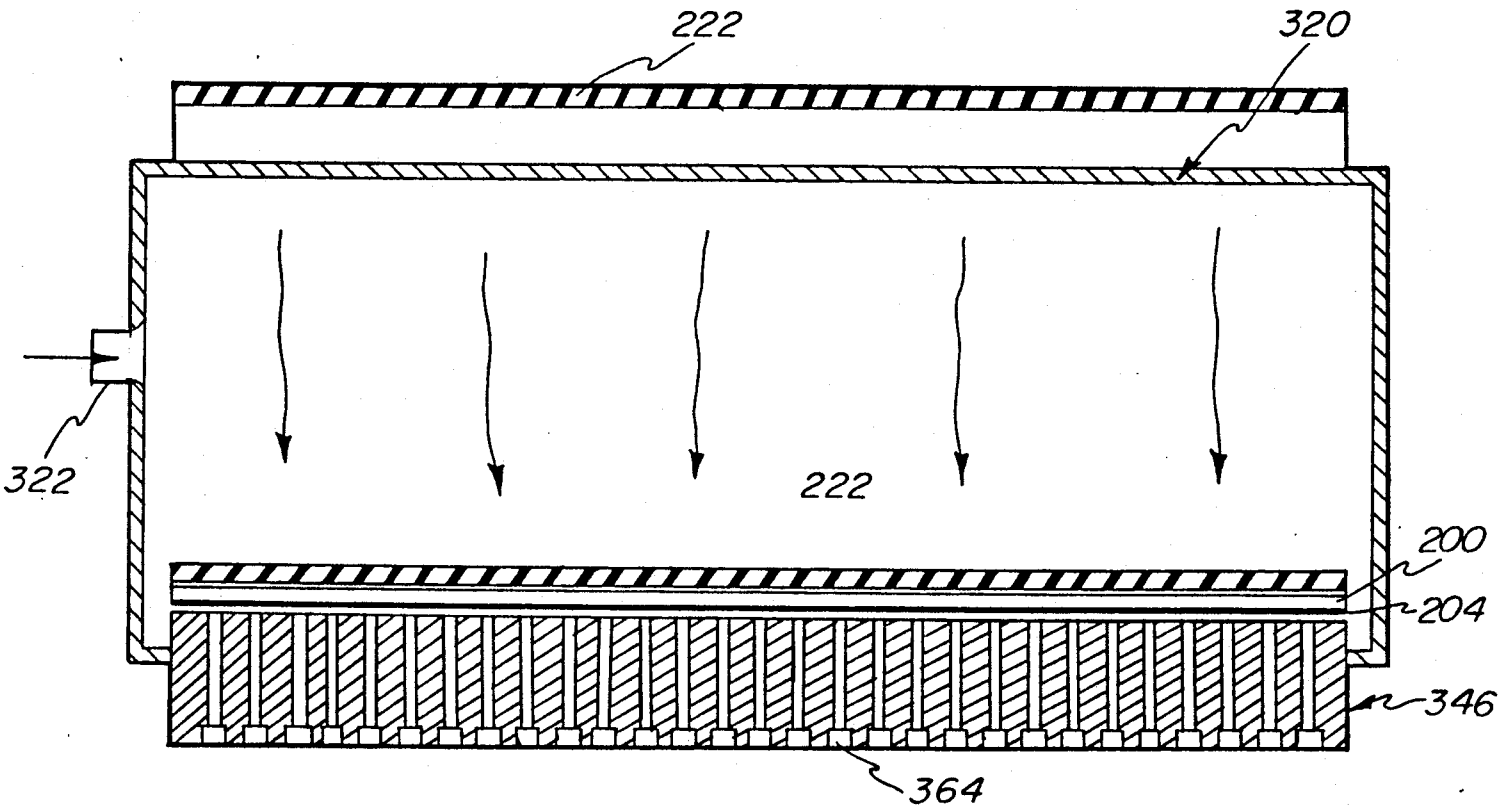
FIG. 16 is a cross-sectional view through lines 16—16 of FIG. 15.

With reference now to FIG. 15, a further embodiment of double facer is possible, using the heater of FIGS. 6 and 7. In this embodiment, a plenum chamber 320 is placed above the heaters 346, as shown in FIG. 15, where the plenum chamber 320 at least partially encloses the heaters 346 along their sidewalls, as shown in FIG. 16. The purpose of the plenum chamber 320 in this embodiment is to provide a positive downward force on the single face board 200 and lower liner paper 204, against the heater 346.

The key to a successful pressurized hold down force is to provide a differential pressure across the corrugated board to be heated. As shown in FIG. 16, an inlet air connection, such as 322, is included along at least one sidewall of the plenum 320, providing an air pressurized atmosphere in the plenum. The pressure in the plenum 320 will act upon the belt 222, and will actually pass through the belt 222, due to its cotton construction, and act directly on the single face board 200. The air pressure in the plenum 320 will also vent through both the single face board 200 and second liner 204, due to their porosity. As the vents 364 extend between the upper and lower surfaces of the heater 346, the upper surface of the heater 346 is at atmospheric pressure, thereby forming a differential pressure across the corrugated paper. This positive hold down force has not been achievable in the past, due to the inability to provide for the plurality of vents 364 in the heater 346.

Figure 17:
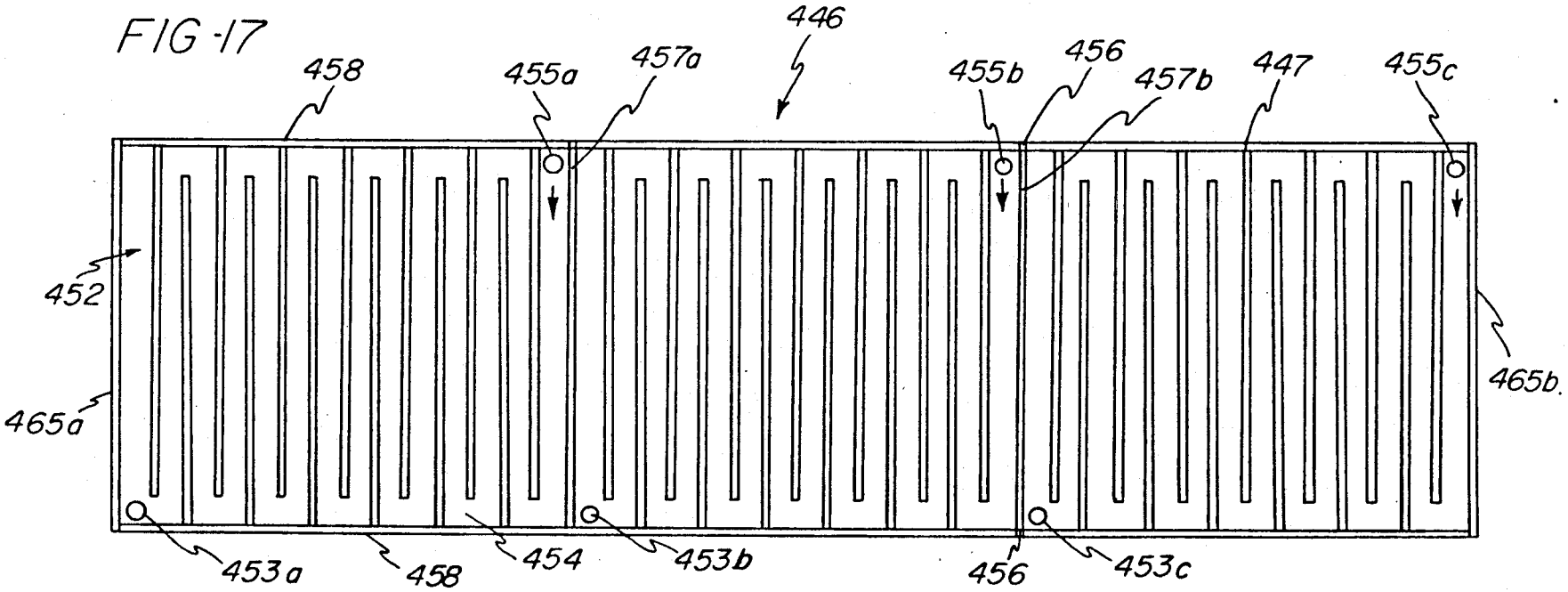
FIG. 17 is a cross-sectional view of a further embodiment of heater.

As shown in FIG. 17, a further embodiment of heater is shown, generally at 446, where the steam flow is in the direction of the paper travel, whereas in the previous heaters, the steam travel was perpendicular to the direction of the paper travel. In this embodiment, channels 452 are provided between side surfaces 456 of the metal plate 447, in the direction of the paper travel. Similar to previous embodiments, slots 454 are included, at the ends of the channels 452, to interconnect adjacent channels 457. However, in this embodiment, two intermediate walls 457*a* and 457*b* are retained, thereby separating the heater into three distinct serpentine paths. The first serpentine path extends between wall 457*a* and end wall 465*a*, and has a steam inlet port 455*a* and a steam outlet port 453*a*. A second serpentine path extends between walls 457*a* and 457*b*, and has a steam inlet port 455*b* and a steam outlet port 453*b*. The third serpentine path extends between end wall 465*b* and intermediate wall 457*b* and has a steam inlet port 455*c* and a steam outlet port 453*c*.

As mentioned earlier, one of the problems which exists with present heating systems is that the center of the paper cures first, while the outer edges of the corrugated board take further surface contact with the heaters for the gelatinization of the adhesive at the outer edges. As also mentioned earlier, if the center section is overheated, the corrugated board may curl up at the center, distorting and weakening the corrugated board.

Figure 19:
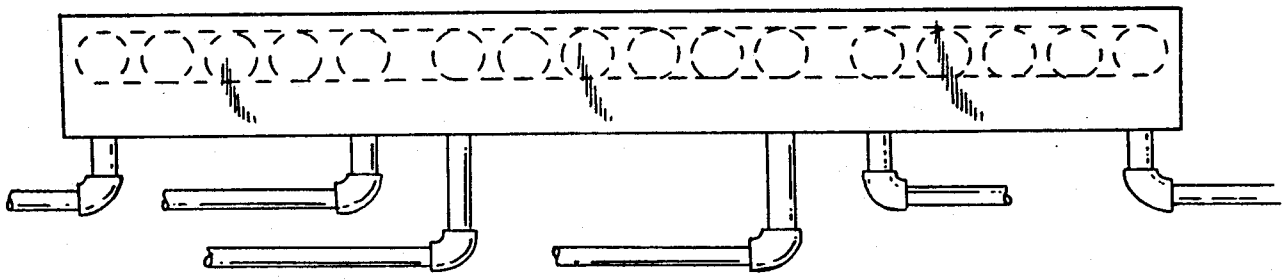
FIG. 19 is a cross-sectional view through lines 19—19 of FIG. 18.
Figure 18:
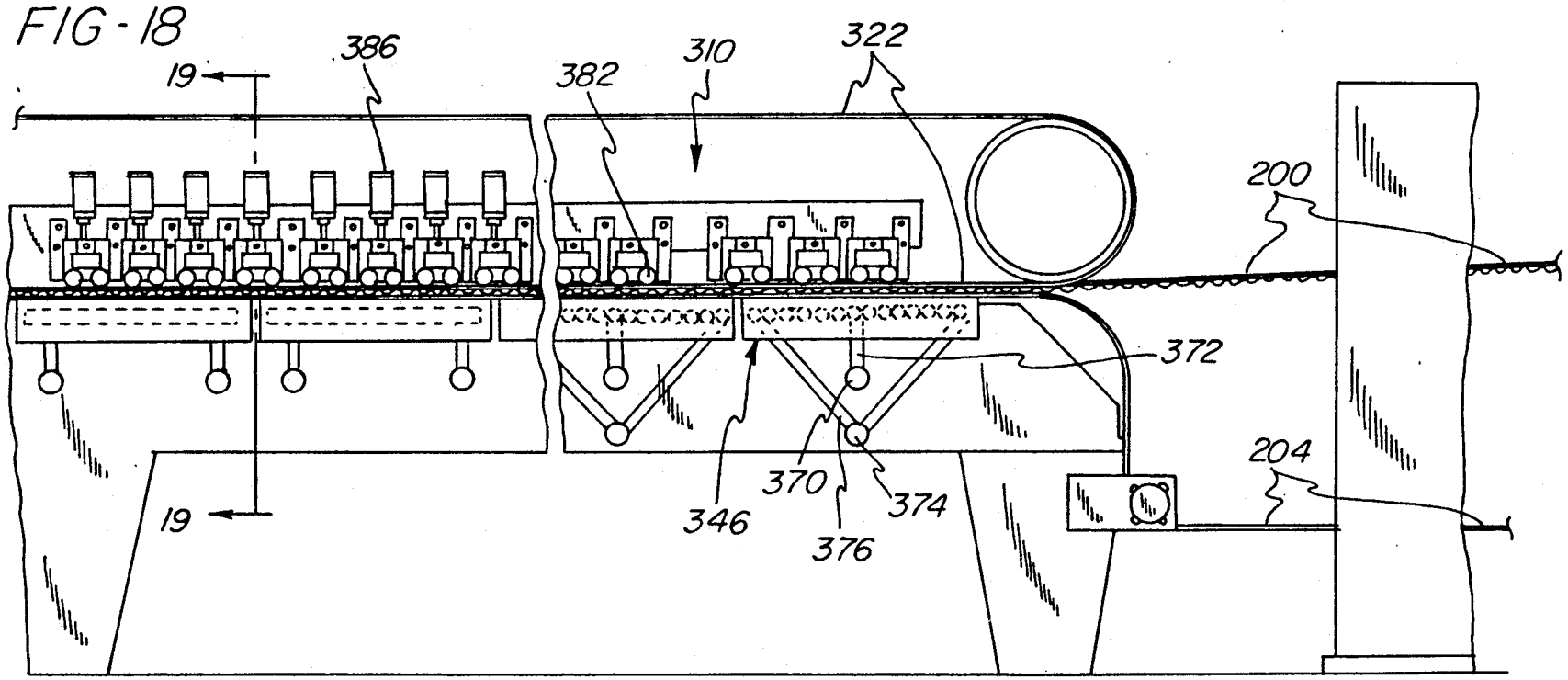
FIG. 18 is a diagrammatical view of a further embodiment of double facer apparatus using the heater of FIG. 17.

To alleviate this dilemma, heaters 446, as shown in FIG. 17, are installed in the downstream location, as shown in FIG. 18. To prevent the center section of the corrugated board from overheating, the center serpentine path is supplied with low temperature steam, approximately 300° F., supplied through inlet and outlet ports 472*b* and 476*b*, respectively, as shown in FIG. 19. On the other hand, the outer serpentine paths are maintained with high temperature steam at 370° F., and supplied through inlet and outlet ports 472*a*, 476*a*, and 472*c*, 476*c*, respectively, also shown in FIG. 19.

Figure 21:
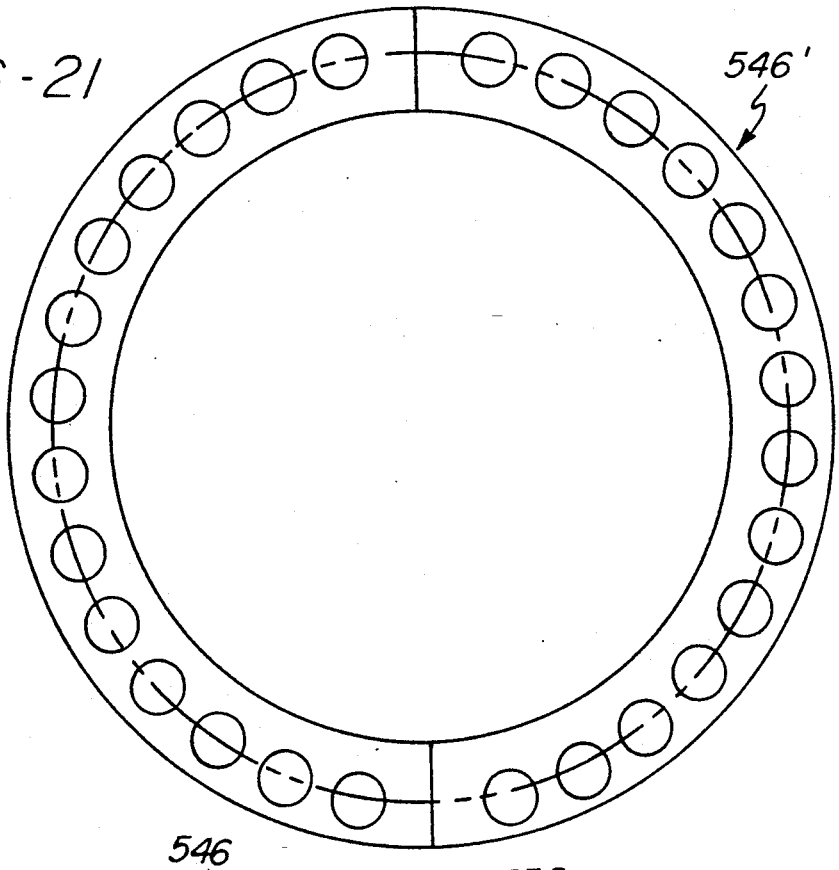
FIG. 21 is an end view of a further embodiment of the invention where the heater is cylindrical in configuration.
Figure 20:
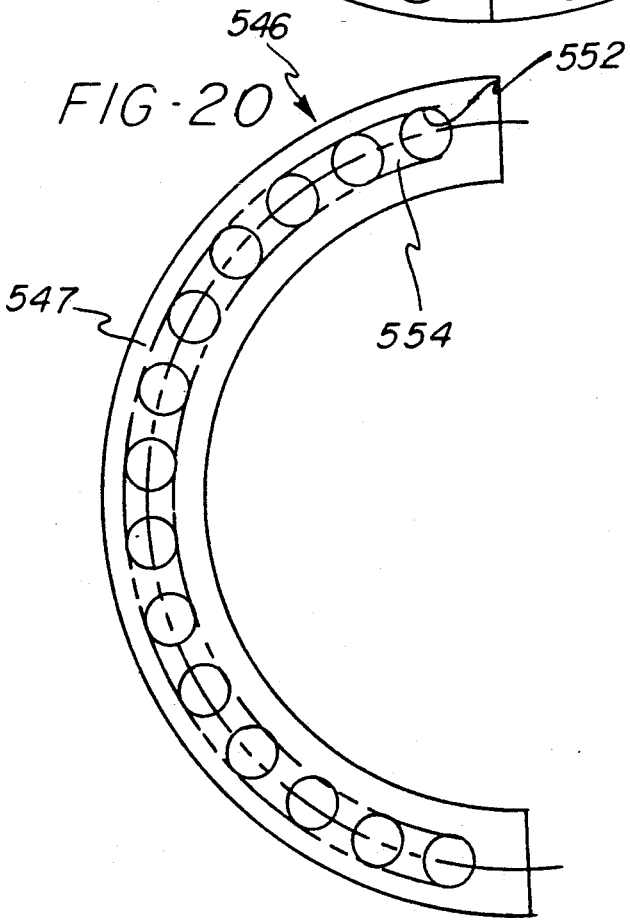
FIG. 20 is an end view of a further embodiment of the invention where the heater is of a half round configuration.

With reference now to FIGS. 20 and 21, the heaters can also be configured as half round or cylindrical. With reference first to FIG. 20, the heater comprises a formed plate 547 having a plurality of channels 552 extending between opposite ends of the plate 547. The heater 546 further includes slots 554 to interconnect adjacent channels at alternate ends to form a serpentine path therethrough. Although not specifically shown, the heater would also include end plates welded to the plate 547 to seal the slots.

To construct a cylindrical heater, two identical heaters 547 are butted together, as shown in FIG. 21, at 546'. Alternatively, the heater 546' can be comprised of an integral cylindrical tube, with the channels drilled through the tube in the desired pattern. The heaters 546, 546' could be used to preheat liner paper approaching the double facer apparatus, for example at location 230, shown in FIG. 5. The liner paper would be drawn over the heater across the outer cylindrical surface.

It should be understood then, that a heater as configured herein, is a substantial improvement over previous heaters, particularly in the areas of thermodynamics and heat transfer. Due to the thin web 260 between the channels and the upper surface 248, the heat transfer rate, is higher than previous heaters, allowing a higher operating surface temperatures.

As mentioned earlier, in the preferred embodiment of the invention, due to the formation of the individual channels for the heater, the channels are placed within ⅜ inches of the upper surface of the heaters, whereas the upper walls of the previous heating vessels were approximately 1 7/16 inches thick. This thin upper wall allows for a higher heat transfer rate, resulting in a higher maintainable upper surface temperature. With the heaters constructed as taught herein, the operating temperature of the upper surface of the heaters can be maintained between 330° F. and 340° F., whereas previous heaters could only be maintained at 300° F.

The heater as configured herein has numerous other advantages. With the channels 252 drilled proximate to the upper surface 248 of the plate 247, a thick web 262 of metal is left below the channels. This web prevents thermal distortion of the heater, when a differential temperature exists between the upper and lower surface of the heater. If a thermal distortion is a problem, stiffening ribs are available for the underside of the heater, and can also be heated with the outlet steam to prevent a temperature differential between the heater and the stiffening ribs.

Furthermore, in accordance with the inventive principles taught herein, the heater can take on several configurations. With the heater configured with individual channels, such as 352, the channels can be spaced at different centerlines than other channels in the same plate 347. This enlarged spacing allows for air vents to be placed between adjacent channels in the same plate, a feature not previously available. These vents can be used to present air pressure to the back side of the double faced board, as shown in FIG. 8, to control the heat imparted to the board.

Alternatively, the heater can be configured with a lower plenum as shown in FIG. 12–14, and the vents 364 can be used to present a vacuum or a pressure to the back side of the double faced board. A further alternative yet, is to provide a plenum above the double faced board as shown in FIGS. 15–16, to provide a positive pressure down on the board, using the vents 364 to provide a differential pressure across the board.

The heater can also be configured as shown in FIG. 17, where the channels are parallel to the direction of paper flow, and the heater can be separated into distinct serpentine heating paths. This allows the separate paths to operate at different temperatures, to selectively heat the board at different temperatures in different zones.

Finally, the heater can also be configured as a half round or a full round heating drum, as shown in FIGS. 20 and 21.

While the form of apparatus herein described, and the method of making the apparatus, constitute preferred embodiments of the invention, it is to be understood that the invention is not limited to this precise form of apparatus and method, and that changes may be made in either without departing from the scope of the invention, which is defined in the appended claims.

What is claimed is:

1. A heating apparatus for imparting heat to paper board passing over an upper surface of the heating apparatus, the heating apparatus comprising:

at least one discrete plate having end faces, and an upper surface and a lower surface;

side-by-side channels extending between one end of the plate and an opposite end, the channels being proximate to the upper surface of the plate, thereby forming a thin web of material between the channels and the upper surface, and a thick web of material between the channels and the lower surface to thereby rigidify the plate, said channels being integrally formed in said at least one discrete plate;

means to interconnect adjacent pairs of channels at alternate ends thereby forming a continuous serpentine passageway between said ends in said discrete plate and parallel to the plane of the upper surface;

at least one heat inlet port in said lower surface, said inlet port communicating with the serpentine passageway;

at least one heat outlet port in said lower surface, said inlet port communicating with the serpentine passageway; and means for imparting a force on said cardboard as it passes said upper surface, said imparting means being capable of supporting the cardboard above said upper surface and also being capable of securing said cardboard against said upper surface; said upper surface of said plate being in direct operative relationship with said cardboard as it passes over said upper surface;

said heating apparatus further comprising strengthening ribs fixed to the lower surface of the plate to further rigidify the plate, said strengthening ribs each lying in a second plane which is generally perpendicular to the plane of said upper surface, said pair of strengthening ribs each having at least one steam passage therethrough and interconnected to the serpentine path in order to heat the strengthening ribs to facilitate minimizing distortion of said plate, said pair of strengthening ribs forming side walls of a chamber which cooperate with said air passages to support said corrugated cardboard either above said upper surface or against said upper surface.

2. The heating apparatus of claim 1, wherein said imparting means further comprises air passages intermediate at least some of the adjacent side-by-side channels extending between the upper and lower surface.

3. The heating apparatus of claim 1, wherein the heating apparatus includes at least two heat outlet ports, and the ribs include steam passages therethrough interconnected to the serpentine passageway to heat the ribs.

4. The heating apparatus of claim 1, wherein the imparting means comprises a plenum chamber beneath the plate, said strengthening ribs forming sidewalls to said plenum chamber.

5. The heating apparatus of claim 4, further comprising means to pressurize the chamber.

6. The heating apparatus of claim 1, wherein said imparting means comprises a vacuum chamber, said strengthening ribs forming sidewalls to said vacuum chamber and said heating apparatus further comprising means for creating a vacuum in the vacuum chamber.

7. The heating apparatus of claim 1, wherein the plate is arcuately curved in a direction of the paper travel.

8. In an apparatus for the manufacture of double face corrugated board, where the apparatus includes means to first produce a single face corrugated board from a medium paper and a first liner paper, receive and precondition the single face corrugated board and a second liner paper, and merge the single face corrugated board and second liner paper together with adhesive applied therebetween, a heating means for gelatinizing the single face corrugated board and second liner paper together, comprises:

a plurality of heating plates aligned side-by-side in a longitudinal array, each plate having an upper and lower surface extending between end faces of the plate, a plurality of channels extending through the plates between the end faces, the channels being parallel to and proximate the upper surfaces of the plates, thereby forming a thin web of material between the channels and the upper surfaces, and a thick web of material between the channels and the lower surfaces to rigidify the plates, the channels being integrally formed in each plate and each plate being interconnected to form a serpentine path circulating through each of the plates, each of the plates further comprising a steam inlet port and a steam outlet port in their lower surface and communicating with the serpentine path to provide a supply of circulating steam to the serpentine path; and at least some of said discrete plates comprising means for imparting a force on said cardboard as it passes said upper surface, said imparting means being capable of supporting the cardboard above said upper surface and also being capable of securing said cardboard against said upper surface; said upper surface of said plate being in direct operative relationship with said cardboard as it passes over said upper surface;

said imparting means comprising air passages in said discrete plate communicating between the upper and lower surfaces, intermediate some of the channels;

each of said discrete plates lies in a first plane and comprises a pair of strengthening ribs secured to said lower surface, said strengthening ribs each lying in a second plane which is generally perpendicular to the first plane, said pair of strengthening ribs each having at least one steam passage therethrough and interconnected to the serpentine path in order to heat the strengthening ribs to facilitate minimizing distortion of said plate, said pair of strengthening ribs forming side walls of a chamber which cooperate with said air passages to support said corrugated cardboard either above said upper surface or against said upper surface.

9. The apparatus of claim 8, further comprising air pressure means to supply air pressure to the air passages from the lower sides of the plates to provide an air cushion between the double face corrugated board and the plates.

10. The apparatus of claim 9, wherein said air pressure means comprises a bi-directional fan.

11. The apparatus of claim 8, wherein the plates are separated into first and second heating sections, the first heating section including vacuum means to apply a vacuum to the air passages to draw the double face corrugated board against the plates, and the second heating section including air pressure means to apply pressurized air to the air passages to provide an air cushion between the double face corrugated board and the heating means.

12. The apparatus of claim 8, further comprising an air pressurized plenum above at some of the heating plates, to provide a positive downward force on the double faced board.

13. In an apparatus for the manufacture of double face corrugated board, where the apparatus includes means to first produce a single face corrugated board from a medium paper and a first liner paper, receive and precondition the single face corrugated board and a second liner paper, and merge the single face corrugated board and second liner paper together with adhesive applied therebetween, a heating means for gelatinizing the single face corrugated board and second liner paper together, comprises:

a plurality of heating plates aligned side-by-side in a longitudinal array, each plate having an upper and lower surface extending between end faces of the plate, a plurality of channels extending through the plates between the end faces, the channels being parallel to and proximate the upper surfaces of the plates, the channels being integrally formed in each plate and each plate being interconnected to form a serpentine path circulating through each of the plates, at least some of the plates having vents extending between the upper and lower surface between adjacent channels, each plate further comprising an inlet port and an outlet port communicating with the serpentine path;

at least some of said heating plates comprising means for imparting a force on said cardboard as it passes said upper surface, said imparting means being capable of supporting the cardboard above said upper surface and also being capable of securing said cardboard against said upper surface; said upper surface of said plate being in direct operative relationship with said cardboard as it passes over said upper surface;

said imparting means comprising air passages in said discrete plate communicating between the upper and lower surfaces, intermediate some of the channels;

said plates lying in a first plane and comprises a pair of strengthening ribs secured to said lower surface, said strengthening ribs each lying in a second plane which is generally perpendicular to the first plane, said pair of strengthening ribs each having at least one steam passage therethrough and interconnected to the serpentine path in order to heat the strengthening ribs to facilitate minimizing distortion of said plate, said pair of strengthening ribs forming side walls of a chamber which cooperate with said air passages to support said corrugated cardboard either above said upper surface or against said upper surface.

14. The apparatus of claim 13, further comprising means for imparting a force on said cardboard as it passes said upper surface, said imparting means being capable of supporting the cardboard above said upper surface and also being capable of securing said cardboard against said upper surface; said upper surface of said plate being in direct operative relationship with said cardboard as it passes over said upper surface, said imparting means comprising air pressure means to supply air pressure to the air vents from the lower sides of the plates to provide an air cushion between the double face corrugated board and the plates.

15. The apparatus of claim 14, further comprising a continuous driven belt passing over the plates directly above the upper surface of the double face corrugated board and a plurality of weight rolls applied to the continuous belt to press the double face corrugated board against the heating means, and lifting means cooperatively attached to the weight rolls to deactivate selected weight rolls from pressing against the belt.

16. The apparatus of claim 14, wherein said imparting means comprises a bi-directional fan.

17. The apparatus of claim 14, wherein the plates are separated into first and second heating sections, the first heating section including vacuum means to apply a vacuum to the air vents to draw the double face corrugated board against the plates, and the second heating section including air pressure means to apply pressurized air to the air vents to provide an air cushion between the double face corrugated board and the heating means.

18. The apparatus of claim 14, further comprising an air pressurized plenum above at least some of the heating plates, to provide a positive downward force on the double faced board.

* * * * *